US008181409B1

(12) United States Patent
Jones

(10) Patent No.: US 8,181,409 B1
(45) Date of Patent: May 22, 2012

(54) ROTATABLE WEDGE SPACER HAVING A CURVED BODY

(76) Inventor: Grant B. Jones, Carlsbad, CA (US)

( * ) Notice: Subject to any disclaimer, the term of this patent is extended or adjusted under 35 U.S.C. 154(b) by 0 days.

(21) Appl. No.: 12/932,282

(22) Filed: Feb. 23, 2011

(51) Int. Cl.
*E04F 13/08* (2006.01)

(52) U.S. Cl. ..... 52/390; 52/749.11; 33/526; 411/535

(58) Field of Classification Search ..... 52/749.1, 52/749.11, 747.1, 677, 384, 390, 126.1; 33/526, 33/527; 411/535, 536, 537, 538
See application file for complete search history.

(56) References Cited

U.S. PATENT DOCUMENTS

D616,725 S * 6/2010 Burns et al. ..... D8/354
D631,326 S * 1/2011 Burns et al. ..... D8/354
2009/0260317 A1* 10/2009 Burns et al. ..... 52/749.11
* cited by examiner

*Primary Examiner* — Brian Glessner
*Assistant Examiner* — Paola Agudelo
(74) *Attorney, Agent, or Firm* — Morland C. Fischer

(57) ABSTRACT

An improved rotatable wedge spacer to be removably positioned in a gap between opposing upper and lower surfaces (e.g., tiles) that are being bonded (e.g., by means of mortar) one above or adjacent the other to a flat surface (e.g., a wall or a floor). The spacer includes a curved (e.g., circular) body having a thin tip at one end and a thick tail at the opposite end. The height of the circular body between an upward sloping top surface thereof and a flat bottom surface increases from the thin tip to the thick tail. A series of flat load-supporting plateaus having predetermined increasing heights are regularly spaced from one another along the top surface so as to lie parallel with the flat bottom surface. With the flat bottom surface of the wedge spacer seated upon the lower tile, the curved body is rotated within the gap until one of the flat load-supporting plateaus along the top surface engages the upper tile. Accordingly, the curved body of the rotatable wedge spacer will fit flush and maintain the gap between the tiles as the mortar cures.

14 Claims, 2 Drawing Sheets

ROTATABLE WEDGE SPACER HAVING A CURVED BODY

BACKGROUND OF THE INVENTION

1. Field of the Invention

This invention relates to an improved rotatable wedge spacer having a curved body that is adapted to be inserted and rotated within a gap between a pair of adjacent tiles that are being bonded to a vertically-extending substrate (e.g., a wall) by means of mortar, or the like, so as to reliably preserve the original positions of the tiles relative to one another as the mortar solidifies. The wedge spacer includes a series of flat load-supporting plateaus that are spaced from one another along an upward sloping top surface of the curved body so as to engage the tiles and prevent a displacement thereof into the gap.

2. Background Art

In my patent application Ser. No. 12/386,227 filed Apr. 14, 2009 and Design Pat. No. D616,725 issued Jun. 1, 2010, a compact rotatable wedge spacer is shown and disclosed to maintain the position of a pair of adjacent tiles that are bonded one above the other to a vertically-extending wall. This wedge spacer includes a curved (e.g., circular) body and represents an improvement over a conventional triangular wedge spacer having a long linear body. In particular, my previously-described wedge spacer is inserted within a gap between the pair of tiles. The wedge spacer can be advantageously rotated within the gap until the pair of tiles engage a tile supporting top surface and a flat bottom surface of the curved body.

Despite the advantages achieved by my compact rotatable wedge spacer, it is sometimes necessary for optimal stability to insert the curved body of the spacer to a depth corresponding to its radius. When the tiles are particularly thin, the spacer may make contact with the sticky mortar and/or not be inserted deep enough to reliably hold the tiles apart. Accordingly, a modification to my wedge spacer is desirable to maintain the gap with optimal stability and without the need to insert the spacer to the full depth of its radius. Another modification that would improve the spacer is to have the ability to achieve any one of a variety of gap widths by creating flat plateaus having predetermined heights along the upwardly sloping top of the spacer so that a workman will be able to select any plateau and maintain a particular gap width without first having to measure.

SUMMARY OF THE INVENTION

An improved rotatable wedge spacer is disclosed having particular application to be removably located within a gap between a pair of adjacent tiles that are positioned one above the other to be bonded to a wall or similar flat surface, such as a floor. The improved rotatable wedge spacer includes a curved (e.g., circular) body having an upward sloping top surface that extends from a thin tip at one end to a thick tail at the opposite end. The curved body of the wedge spacer also has a flat bottom surface lying opposite the upward sloping top surface. The top and bottom surfaces of the wedge spacer run between curved inside and outside edges of the curved body. A series of flat load-supporting plateaus are spaced from one another along the upward sloping top surface of the curved body. The flat plateaus lie parallel to the flat bottom surface. Thus, each successive plateau has a height above the flat bottom surface which is greater than the height of the preceding plateau. The heights of the plateaus preferably increase from one to the next by a predetermined amount. At least one side of each plateau is tangent to the curved inside edge of the curved body.

With the wedge spacer pushed between the tiles to fill the gap, the curved body can be rotated until the upper tile of the pair is seated flush against one of the flat load-supporting plateaus along the top surface of the curved body. The lower tile of the pair engages the flat bottom surface of the curved body. The rotation of the rotatable wedge spacer is dependent upon the width of the gap to be filled. Accordingly, the upper tile will be unable to slide downwardly along the wall and tip towards the lower tile so that the spacing between the tiles and the size of the gap are reliably preserved.

DESCRIPTION OF THE PREFERRED EMBODIMENT

Figure 1:
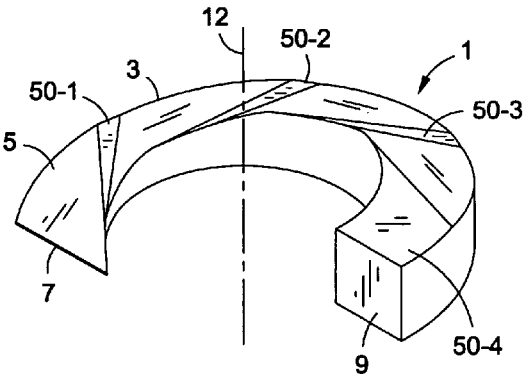
FIG. 1 is a perspective view of an improved rotatable wedge spacer having a curved upward sloping body and a series of load-supporting plateaus spaced from one another therealong according to a preferred embodiment of this invention.

Referring concurrently to FIGS. 1-4 of the drawings, there is shown an improved rotatable wedge spacer 1 according to a preferred embodiment of this invention. The rotatable wedge spacer 1 is preferably molded from plastic. However, the material and method for manufacturing wedge spacer 1 should not be regarded as a limitation of this invention. The improved rotatable wedge spacer 1 includes a curved body 3 having an upward sloping or inclined top surface 5 that runs therealong from a thin tip 7 at one end to a thick tail 9 at the opposite end. The curved body 3 surrounds an open interior area 10. The bottom surface 11 of the curved body 3 is flat.

Figure 2:
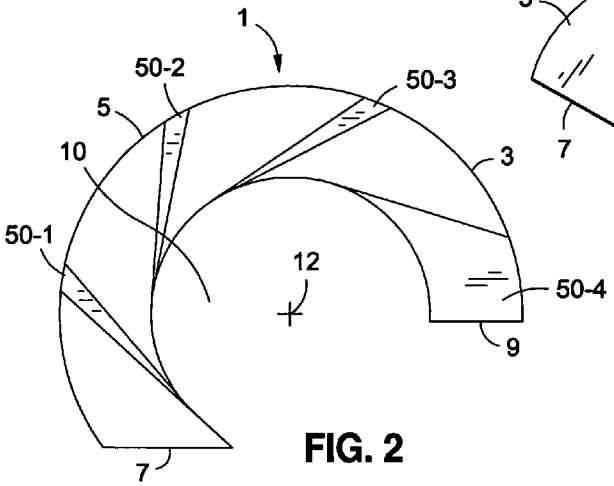
FIG. 2 is a top view of the improved rotatable wedge spacer of FIG. 1.

The curved body 3 of spacer 1 lies in co-axial alignment with a longitudinal axis 12 (best shown in FIGS. 1 and 2). To this end, at least some of the curved body 3 is preferably circular so as to define a portion (i.e., greater than 180 degrees) of a circle that surrounds the longitudinal axis 12 so as to maintain a constant radius (best shown in FIG. 2) and have an ideal outside diameter of approximately 1 inch. While a circular body is shown in FIG. 2, it is to be understood that the curved body 3 of spacer 1 can also have other shapes such as that resembling a "U" or a horseshoe (not shown).

The height of the curved body 3 of wedge spacer 1 varies (i.e., increases) between the top surface 5 and the flat bottom surface 11 from the thin tip 7 to the thick tail 9. The maximum height of the wedge spacer 1 at the thick tail 9 is ideally approximately ½ inch for the preferred application of the spacer 1 to be described hereinafter when referring to FIGS. 6-8. The tail 9 (best shown in FIG. 1) has a generally rectangular shape. However, the tail 9 of curved body 3 may have other suitable shapes, such as that of a triangle, an arch or a circle.

Figure 3:
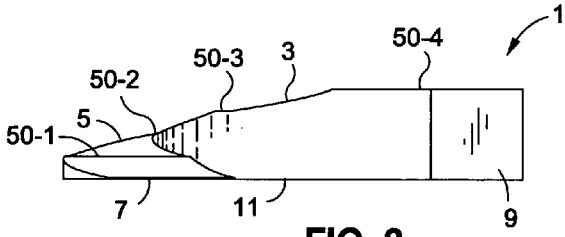
FIG. 3 is a front view of the improved rotatable wedge spacer of FIG. 1.
Figure 4:
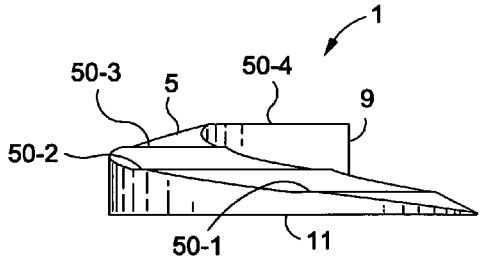
FIG. 4 is a rear view of the improved rotatable wedge spacer of FIG. 1.

As is best shown in FIG. 3, the thin tip 7 (i.e., the location where the height of the curved body 3 of the rotatable wedge spacer 1 is the smallest) creates an angled surface similar to that of the conventional planar wedge spacer. Also like the conventional wedge spacer, the height of the curved body 5 of the rotatable wedge spacer 1 of FIGS. 1-4 increases from the tip 7 to the tail 9. However, by virtue of its curved body 3, the rotatable wedge spacer 1 reaches its maximum height over a shorter linear distance corresponding to its diameter than the linear distance that is characteristic of the conventional planar wedge spacer.

As an important aspect of this invention, the wedge spacer 1 has a series of load-supporting plateaus 50-1 . . . 50-4 that extend between inside and outside edges of the curved body 3 and are spaced from one another around the curved body 3. Unlike the upward sloping and inclined top surface 5 of the curved body 3, each plateau is flat. In particular, the tops of the flat plateaus 50-1 . . . 50-4 extend horizontally and in parallel alignment with the flat bottom surface 11. It is preferable that the series of plateaus are uniformly spaced from one another.

Each successive plateau from the series of plateaus 50-1 . . . 50-4 around the curved body 3 from the thin tip 7 to the thick tail 9 is higher relative to the flat bottom surface 11 than the previous plateau. Hence, the last plateau 50-4 has the greatest height, and the first plateau 50-1 has the least height. The number and actual height of the flat plateaus 50-1 . . . 50-4 are matters of choice. However, so as to enable a workman to easily ascertain the height of the wedge spacer 1 at any one of the plateaus thereof without having to measure, it is preferable that the heights of successive plateaus 50-1 . . . 50-4 increase uniformly from one plateau to the next. By way of example only, the height of the first plateau 50-1 may be ⅛ inch, the height of the second plateau 50-2 may be ¼ inch, the height of the third plateau 50-3 may be ⅜ inch, and so on. Thus, the workman need only count the number of plateaus starting from the tip 7 to determine the height of any particular plateau above the flat bottom surface 11.

To achieve a smooth transition from one plateau to the next, the height of the upward sloping top surface 5 of the wedge spacer 1 above the flat bottom surface 11 increases continuously from the tip 7 to the first flat plateau 50-1. The height of the sloping top surface 5 above the flat bottom surface 11 increases further from the first flat plateau 50-1 to the second flat plateau 50-2. The height of the top surface 5 continues its increase between the second to the third flat plateaus 50-2 and 50-3, and so on around the curved body 3. It may therefore be appreciated that the upward sloping top surface 5 is only interrupted by the flat plateaus 50-1 . . . 50-4 which are spaced from one another around the curved body 3.

Figure 5:
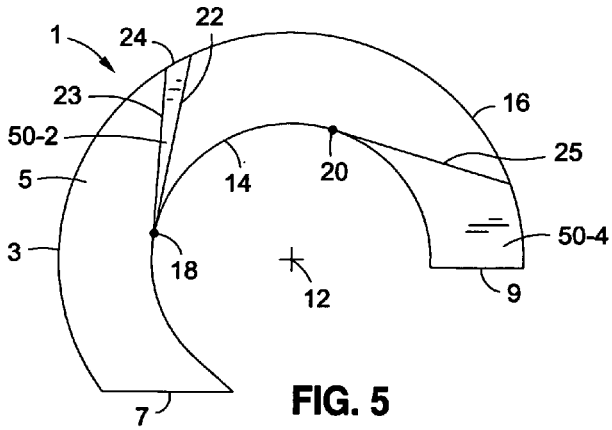
FIG. 5 is another top view of the improved rotatable wedge spacer of FIG. 1 showing details of some of the load supporting plateaus thereof.

FIG. 5 of the drawings shows a top view of the rotatable wedge spacer 1 of FIG. 1 to illustrate details of the improvement of this invention. The curved body 3 of spacer 1 has a curved (e.g., circular) inside edge 14 and a similarly curved (e.g., circular) outside edge 16 that are separated from one another by the upward sloping top surface 5 and the flat bottom surface 11.

Each of the load-supporting plateaus (e.g., 50-2) of wedge spacer 1 with the exception of the last plateau 50-4 has a generally triangular configuration. More particularly, the plateau 50-2 has first and opposing sides 22 and 23 which intersect one another at first ends thereof at a single point 18 lying on the curved inside edge 14 of the curved body 5. The third side 24 of triangular plateau 50-2 extends between the opposite ends of the sides 22 and 23 and lies on the curved outside edge 16.

It may be appreciated that any point along the third side 24 of the flat plateau 50-2 has the same height above the flat bottom surface 11 of the curved body 3 as the height of point 18 at which the first and second sides 22 and 23 intersect one another. Moreover, each of the first and second sides 22 and 23 of plateau 50-2 which runs through the same point 18 located on the curved inside edge 14 of the curved body 5 is tangent to the curved inside edge 14. In this same regard, point 18 on the curved inside edge 14 is located closer to the thin tip 7 than the third side 24 of plateau 50-2 on the curved outside edge 16.

The configuration of each of the other load-supporting plateaus 50-1 and 50-3 of the wedge spacer 1 (except for the last plateau 50-4) is identical to the just-described configuration of plateau 50-2. Continuing to refer to FIG. 5, the last load-supporting plateau 50-4 has a generally trapezoidal configuration and includes a first side 25 and an opposite side that is spaced from the first side 25 and located at the end of the thick tail 9 of wedge spacer 1. A third side of plateau 50-4 extends between sides 25 and 9 and lies on the curved inside edge 14 of the curved body 3, while the fourth side of plateau 50-4 also extends between sides 25 and 9 but lies on the curved outside edge 16 of curved body 3. The first side 25 of plateau 50-4 runs through a single point 20 located on the curved inside edge 14 of the curved body 3, such that the side 25 is tangent to curved inside edge 14.

Figure 6:
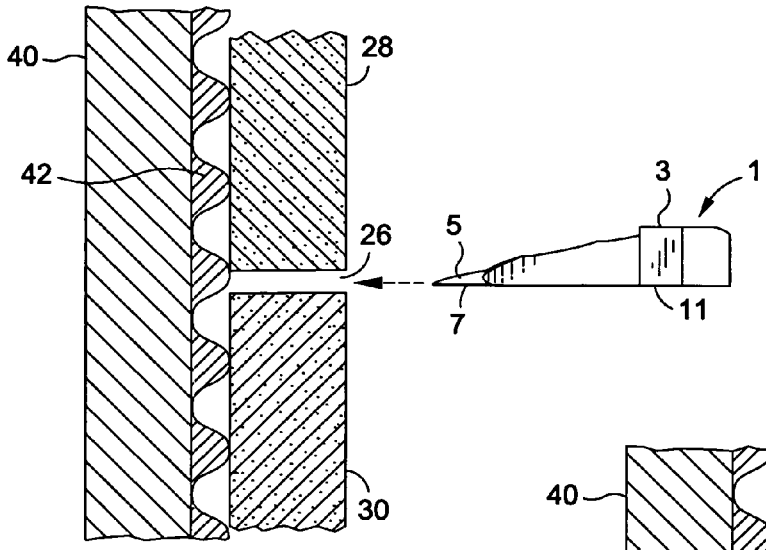
FIG. 6 shows the rotatable wedge spacer of FIGS. 1-4 ready to be inserted within a gap of relatively small width between a pair of tiles being bonded to a vertical wall.

Turning now to FIG. 6 of the drawings, the rotatable wedge spacer 1 described above is shown ready for use. Spacer 1 has particular application to be removably located within a gap 26 between a pair of tiles 28 and 30 that are to be bonded above or adjacent one another to a vertically-extending substrate (e.g., a wall 40 or the like) by means of mortar 42 or a similar adhesive. The spacer 1 is sized to be inserted in the gap 26 between the pair of tiles 28 and 30 so as to prevent a displacement and preserve the original positions of the tiles relative to one another as the mortar 42 solidifies. The spacer 1 also preserves the size of the gap 26 between tiles 28 and 30. However, it is to be understood that the rotatable wedge spacer 1 of this invention has applications in addition to that just described. By way of example only, the spacer 1 can be removably inserted between the end of a horizontal wooden floor plank and a wall, such as during the construction or remodeling of a room.

In the example of FIG. 6, a relatively small (i.e., thin) gap 26 separates opposing upper and lower tiles 28 and 30 from one another. The rotatable wedge spacer 1 is simply pushed directly towards the tiles 28 and 30 so that the curved body 3 is located in and fills the gap 26 therebetween. In this case, the thin tip 7 at the beginning of the upward sloping top surface 5 of wedge spacer 1 will engage the upper tile 28, and the flat bottom surface 11 will engage the lower tile 30 so as to prevent a displacement of and hold the tiles apart.

Figure 7:
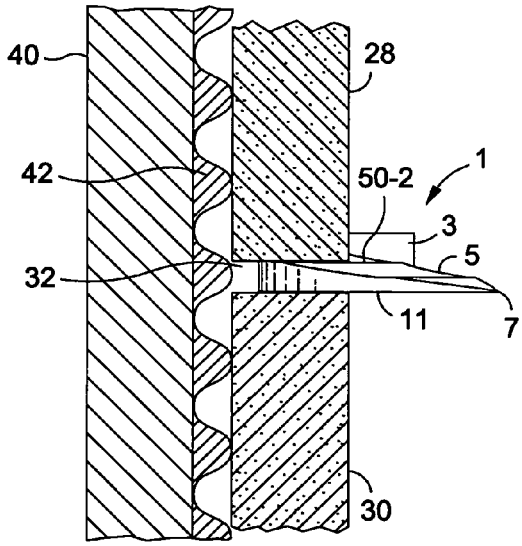
FIG. 7 shows the rotatable wedge spacer of FIGS. 1-4 inserted and rotated within a gap having a larger width than the width of the gap shown in FIG. 6.
Figure 8:
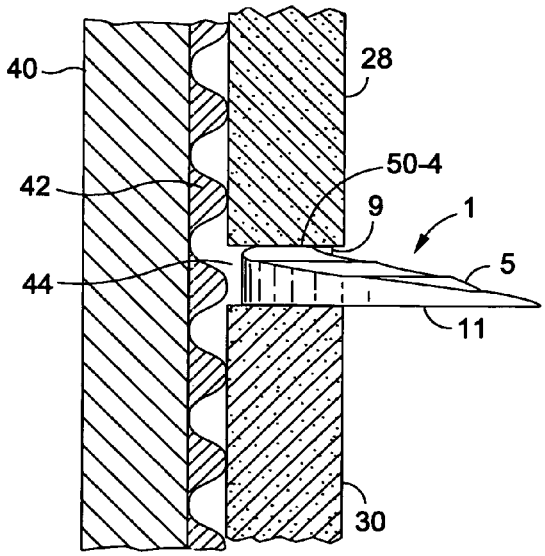
FIG. 8 shows the rotatable wedge spacer of FIGS. 1-4 inserted and rotated within a gap having a still larger width relative to the widths of the gaps shown in FIGS. 6 and 7.

In FIG. 7, a larger (i.e., wider) gap 32 separates the upper and lower tiles 28 from one another. In FIG. 8, a relatively large (i.e., still wider) gap 44 separates the upper and lower tiles 28 and 30. Once it has been inserted, the rotatable wedge spacer 1 can be selectively rotated (in either of a clockwise or a counter-clockwise direction) around its longitudinal axis (designated 12 in FIG. 1) as is necessary to adjust the position of the curved body 3 within the gap 32 or 44 until the wedge spacer 1 fits flush between the tiles 28 and 30.

That is, and in the case of FIG. 7, the rotatable wedge spacer 1 is rotated until one of the flat load-supporting plateaus (e.g., 50-2) having a first height engages the upper tile 28 and the flat bottom surface 11 engages the lower tile 30. In the case of FIG. 8, the wedge spacer 1 is rotated until a different one of the flat load-supporting plateaus (e.g., 50-4) having a different height engages the upper tile 28 and the flat bottom surface engages the lower tile 30.

As previously described, the flat load-supporting plateaus 50-1 . . . 50-4 lie horizontal and parallel to the flat bottom surface 11 of the curved body 3 of the rotatable wedge spacer 1. By virtue of the foregoing, the upper tile 28 will be seated upon and extend laterally and completely across one of the plateaus (50-2 of FIG. 7 or 50-4 of FIG. 8) between the curved inside and outside edges 14 and 16 of curved body 3. In this same regard, it may be appreciated that the wedge spacer 1 need be pushed into the gaps 26, 32 and 44 so that only the inside and outside edges 14 and 16 of the curved body 3 are located between the tiles 28 and 30 (best shown in FIGS. 7 and 8). Thus, the spacer 1 will not penetrate the mortar 42 while curing. Once it has been inserted, the amount of rotation of the rotatable wedge spacer 1 and the particular load-supporting plateau upon which the upper tile 28 is seated will depend upon the width of the gap 32 or 44. Accordingly, the ability of the upper tile 28 to slide along the wall 40 and change its position within the gap 26, 32 or 44 and/or tip towards the lower tile 30 will be avoided so that the spacing of the upper and lower tiles 28 and 30 relative to one another can be reliably maintained.

Shortly before the mortar 42 has set and hardened and the tiles 28 and 30 are immovably affixed to the wall 40, the wedge spacer 1 is pulled outwardly from the gap therebetween. However, the tiles 28 and 30 are now held in place against the wall 40 to maintain a uniform gap width. Once the mortar 42 has fully hardened, the gap between the tiles can be filled with grout or any other suitable structurally-supportive material.

The invention claimed is:

1. For maintaining the spacing between first and opposite surfaces that are separated from one another by a gap, a spacer including a curved body adapted to be removably positioned in said gap, said curved body having an upward sloping top to engage one of said surfaces and a flat bottom to engage the opposite surface, said curved body also having an outside edge, a curved inside edge and a series of flat plateaus that are spaced from one another along said upward sloping top and are aligned parallel to said flat bottom, each of said plateaus having at least one side that runs between the outside and inside edges of said curved body and is tangent to said curved inside edge at a point lying on said inside edge.

2. The spacer recited in claim 1, wherein the height of any one of said series of flat spacers along said upward sloping top relative to said flat bottom is greater than the height of a preceding one of said spacers and less than the height of a succeeding one of said spacers.

3. The spacer recited in claim 2, wherein the difference between the height of any one of said series of flat spacers relative to the flat bottom and the height of the preceding one of said spacers is identical to the difference between the height of said one spacer and the height of the succeeding one of said spacers.

4. The spacer recited in claim 1, wherein each of the outside and inside edges of said curved body is curved.

5. The spacer recited in claim 1, wherein each of the outside and inside edges of said curved body is round.

6. The spacer recited in claim 5, wherein there is an open space lying inside and surrounded by the round inside edge of said curved body, said curved body having a longitudinal axis running through said open space, such that said longitudinal axis is coaxially aligned with at least some of the round outside and inside edges of said curved body.

7. The spacer recited in claim 6, wherein said curved body is rotatable within the gap around the longitudinal axis thereof until the flat bottom of said curved body lies flush against a first of said surfaces and one of said series of flat plateaus along the upward sloping top of said curved body lies flush against the opposite surface, such that the second surface extends completely across and is seated upon said one plateau between the round outside and inside edges of said curved body.

8. The spacer recited in claim 1, wherein said curved body has first and opposite ends, said first end being a wedge having a height above the flat bottom of said curved body that is less than the height of the opposite end of said curved body.

9. The spacer recited in claim 1, wherein each of at least some of said series of flat plateaus has first and second sides that run between the outside and inside edges of said curved body so as to intersect one another and lie tangent to said curved inside edge at the same point lying on said curved inside edge.

10. The spacer recited in claim 9, wherein each of said at least some flat plateaus also has a third side which lies on the curved outside edge of said curved body and extends between said first and second sides.

11. The spacer recited in claim 10, wherein said curved body has first and opposite ends, said first end being narrower than said opposite end, the point on the inside edge of said curved body at which the first and second sides of each one of said at lest some flat plateaus intersect one another lying closer to said narrower first end than the third side of each plateau.

12. The spacer recited in claim 11, wherein the point on the inside edge of the curved body at which the first and second sides of each one of said at least some flat plateaus intersect one another has a height above the flat bottom of said curved body which is identical to the height of the third side of each plateau.

13. The spacer recited in claim 11, wherein the height of the upward sloping top of said curved body above the flat bottom thereof increases continuously between each of said series of flat plateaus that are spaced from one another along said top.

14. For maintaining the spacing between first and opposite surfaces that are separated from one another by a gap, a spacer including a rotatable body adapted to be removably positioned in and rotated within said gap, said rotatable body having an upward sloping top to engage one of said surfaces and a flat bottom to engage the opposite surface, said rotatable body also having an outside edge, a curved inside edge and a series of flat plateaus that are spaced from one another along said upward sloping top and are aligned parallel to said flat bottom, at least some of said plateaus having first and second sides that run between the outside and inside edges of said rotatable body so as to intersect one another at and lie tangent to said curved inside edge at the same point lying on said curved inside edge.

* * * * *